US011568804B2

(12) United States Patent
Wang

(10) Patent No.: US 11,568,804 B2
(45) Date of Patent: Jan. 31, 2023

(54) DRIVING CIRCUIT, DISPLAY DEVICE, AND DRIVING METHOD THEREOF

(71) Applicant: BOE TECHNOLOGY GROUP CO., LTD., Beijing (CN)

(72) Inventor: Wenbo Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 396 days.

(21) Appl. No.: 16/615,688

(22) PCT Filed: Jun. 13, 2019

(86) PCT No.: PCT/CN2019/091074
§ 371 (c)(1),
(2) Date: Nov. 21, 2019

(87) PCT Pub. No.: WO2020/029681
PCT Pub. Date: Feb. 13, 2020

(65) Prior Publication Data

US 2021/0358400 A1 Nov. 18, 2021

(30) Foreign Application Priority Data

Aug. 6, 2018 (CN) ..... 201810885699.2

(51) Int. Cl.
*G09G 3/3208* (2016.01)

(52) U.S. Cl.
CPC ... *G09G 3/3208* (2013.01); *G09G 2310/0221* (2013.01); *G09G 2320/0626* (2013.01);
(Continued)

(58) Field of Classification Search
CPC ..... G09G 3/3208; G09G 2310/0221; G09G 2320/0626; G09G 2330/021; G09G 2360/145; G09G 2360/16
See application file for complete search history.

(56) References Cited

U.S. PATENT DOCUMENTS

2005/0184937 A1* 8/2005 Lee ..... G09G 3/3225 345/82
2011/0115830 A1* 5/2011 Lee ..... G09G 3/3233 345/76

(Continued)

*Primary Examiner* — Amare Mengistu
*Assistant Examiner* — Jennifer L Zubajlo
(74) *Attorney, Agent, or Firm* — Syncoda LLC; Feng Ma

(57) ABSTRACT

A display panel driving system includes: a display panel having a first panel partition and a second panel partition; a first display driving circuit operatively connected to the first panel partition and configured to drive the first panel partition; a second display driving circuit operatively connected to the second panel partition and configured to drive the second panel partition; and a comparison circuit respectively connected to the first and second display driving circuits; each display driving circuit is utilized to collect brightness level statistics associated with the display panel partitions it drives; each display driving circuit is configured to determine a cathode voltage value associated with the display panel partition it drives and transmit the cathode voltage value to the comparison circuit for comparison for each of the panel partitions and determine a target value which is then utilized to adjust the cathode voltage of the whole display panel.

20 Claims, 11 Drawing Sheets

(52) U.S. Cl.
CPC . *G09G 2330/021* (2013.01); *G09G 2360/145* (2013.01); *G09G 2360/16* (2013.01)

(56) References Cited

U.S. PATENT DOCUMENTS

| | | | | |
|---|---|---|---|---|
| 2016/0012776 | A1* | 1/2016 | Kong | G09G 3/3208 345/77 |
| 2016/0027377 | A1* | 1/2016 | Cho | G09G 3/3208 315/172 |
| 2017/0103707 | A1* | 4/2017 | Park | G09G 3/2003 |
| 2017/0163266 | A1* | 6/2017 | Chen | G09G 3/3233 |
| 2017/0256209 | A1* | 9/2017 | Kang | G09G 3/3413 |
| 2017/0270889 | A1* | 9/2017 | Kang | G09G 3/3688 |
| 2018/0211619 | A1* | 7/2018 | Ma | G09G 3/3666 |
| 2018/0330668 | A1* | 11/2018 | Luo | H01L 29/78648 |
| 2018/0336822 | A1* | 11/2018 | Yan | G09G 3/3233 |
| 2019/0156753 | A1* | 5/2019 | Yang | G09G 3/3266 |
| 2019/0213955 | A1* | 7/2019 | Chen | G09G 3/2003 |
| 2020/0167030 | A1* | 5/2020 | Lin | G09G 3/3208 |

* cited by examiner

DRIVING CIRCUIT, DISPLAY DEVICE, AND DRIVING METHOD THEREOF

CROSS-REFERENCE TO RELATED APPLICATION

The present application claims priority to Chinese Patent Application No. 201810885699.2 filed on Aug. 6, 2018, the disclosure of which is hereby incorporated by reference in its entirety.

TECHNICAL FIELD

The present disclosure relates generally to the fields of display technologies, and more specifically relates to a driving circuit, a display device, and driving method thereof.

BACKGROUND

With the development of display technologies and the wide application of display components, organic light-emitting components (OLED) are widely utilized in various display components such as smart phones, tablets and laptops because of their advantages such as low power consumption, high response speed and flexibility.

At present, the common methods for reducing power consumption of OLED components are often achieved by collecting brightness level statistics of the display panel, and measuring the cathode voltage (ELVss) of the light-emitting layer of an OLED component and then dynamically adjusting the brightness and voltages so as to reduce power consumption. However, for applications in which the display panel is driven by a combination of display driver integrated circuit (DDIC) chips, where different DDIC chips drive different regions of the display panel independently, brightness level statistics of the whole display panel cannot be collected. As a result, in the application scenarios in which the display panel is driven by a combination of DDIC chips, the function of ELVss dynamic adjustment cannot be performed, and ultimately, the power consumption of the OLED component can thus not be reduced.

SUMMARY

Contemplated herein is a driving circuit, a display device, and driving method thereof which when utilized solve many of the aforementioned problems. For purposes of illustration of the various inventive concepts contemplated herein, the concepts will be discussed primarily with regard to scenarios in which the display panel is driven by a combination of numerous DDIC chips, where previously the brightness level statistics of the whole display panel could not be collected making it difficult or impossible to adjust and reduce power consumption.

In a first aspect, a display panel driving system is provided, including:

a display panel having a first panel partition and a second panel partition;

a first display driving circuit operatively connected to the first panel partition, the first display driving circuit being utilized for driving the first panel partition;

a second display driving circuit operatively connected to the second panel partition, the second display driving circuit being utilized for driving the second panel partition; and a comparison circuit, wherein:

the comparison circuit is respectively connected to each of the first display driving circuit and the second display driving circuit;

each display driving circuit is utilized to collect brightness level statistics associated with the display panel partitions it drives;

each display driving circuit is configured to determine a cathode voltage value associated with the display panel partition it drives and transmit the cathode voltage value to the comparison circuit; and the comparison circuit is utilized to compare each cathode voltage value for each of the panel partitions received and determine a target value which is then utilized to adjust the cathode voltage of the whole display panel.

In some embodiments, the comparison circuit is utilized to determine a target value according to the minimum cathode voltage value among a plurality of cathode voltage values received.

In some embodiments, the display panel driving system further includes a power management circuit being connected to the comparison circuit and the display panel, wherein the comparison circuit is further utilized to transmit the target value to the power management circuit; and wherein the power management circuit is utilized to transmit the target value received to the display panel, such that the cathode voltage value of the display panel can be adjusted according to the target value.

In some embodiments, the comparison circuit is provided externally to each display driving circuit, and wherein each display driving circuit is connected to the comparison circuit through a serial peripheral interface or a two-wire interface serial bus.

In some embodiments, the comparison circuit is provided inside the first display driving circuit, and the first display driving circuit is respectively connected to each second display driving circuit through a serial peripheral interface or a two-wire interface serial bus.

In some embodiments, the power management circuit is connected to the display panel through a signal line interface.

In some embodiments, each display panel operates in a plurality of display frames, wherein each display frame comprises a display period and an idle period; wherein the driving circuit is utilized to collect brightness level statistics of a subsequent display frame, determine an associated cathode voltage, determine an associated target value and adjust the cathode voltage of the display panel in accordance with the associated target value during the idle period that is after the display period of a present display frame and before the display period of the subsequent display frame.

In some embodiments, the display panel is an organic light-emitting diode display panel.

In another aspect, a driving method of a display device is provided, the method including:

providing an organic electroluminescent display panel having a plurality of panel partitions;

providing a plurality of display driving circuits that respectively drive each of the plurality of panel partitions in a one-to-one ration;

providing a comparison circuit, wherein the comparison circuit is respectively connected to each display driving circuit;

utilizing each display driving circuit so as to collect associated brightness level statistics of each panel partition;

utilizing each display driving circuit so as to determine a cathode voltage value for each panel partition, and transmit the cathode voltage value to the comparison circuit;

utilizing the comparison circuit so as to compare each of the cathode voltage values associated with each panel partition; and determining a target value for each panel partition which is then utilized to adjust a cathode voltage provided to the organic electroluminescent display panel.

In some embodiments, step of determining the target value is performed by the comparison circuit, and wherein this step further comprises:

determining a minimum cathode voltage value among each of the cathode voltage values received as the target value.

In some embodiments, the display device further includes a power management circuit that is respectively connected to the comparison circuit and the display panel, and wherein the method further includes steps of:

utilizing the comparison circuit to transmit the target value to the power management circuit;

utilizing the power management circuit to transmit the target value to the display panel in order to adjust the cathode voltage of the display panel in accordance with each target value.

In Some Embodiments:

each display frame of the display device operates having a display period and an idle period; and the method further includes:

obtaining the brightness level statistics, determining the cathode voltage, determining the target value and adjusting the cathode voltage of the display panel in accordance the target value includes:

collecting brightness level statistics of a subsequent display frame during the idle period after the display period of the present display frame and before the display period of the next display frame;

determining the cathode voltage;

determining the target value; and adjusting the cathode voltage of the display panel in accordance with the target value.

In another aspect, a computing device operatively connected to a display panel is provided, wherein the computing device includes:

a storage device; and a processor operatively connected to the storage device and to the display panel;

wherein the storage device is utilized to store executable commands, and wherein the processor is utilized to execute the executable commands configured to instruct the processor to perform the steps of the driving method of the display.

In another aspect, a non-transitory computer-readable storage medium is provided, wherein, the computer-readable medium is utilized to store executable commands, when the executable commands are executed so as to perform the driving method.

In another aspect, a display panel driving system is provided, the system including:

a display panel having a plurality of panel partitions, wherein the display panel is an organic light-emitting diode display panel;

a plurality of display driving circuits operatively connected to each of the plurality of panel partitions, each of the panel partitions having an associated display driving circuit;

a comparison circuit, wherein:

the comparison circuit is respectively connected to each of the display driving circuits in a one-to-one ratio;

each display driving circuit is utilized to collect brightness level statistics associated with each associated display panel partitions driven thereby;

each display driving circuit is configured to determine an associated cathode voltage value associated with its particular display panel partition driven thereby and transmit the associated cathode voltage value to the comparison circuit; and the comparison circuit is utilized to compare each associated cathode voltage value for each of the panel partitions and determine a target value which is then utilized to adjust the cathode voltage of the whole display panel.

In some embodiments, the comparison circuit is utilized to determine a target value according to the minimum cathode voltage value among a plurality of cathode voltage values received.

In some embodiments, the display panel driving system further includes a power management circuit being connected to the comparison circuit and the display panel, wherein the comparison circuit is further utilized to transmit the target value to the power management circuit, and wherein the power management circuit is utilized to transmit the target value received to the display panel, such that the cathode voltage value of the display panel can be adjusted according to the target value.

In some embodiments, the comparison circuit is provided externally to all of the display driving circuits.

In some embodiments, each display driving circuit is connected to the comparison circuit through a serial peripheral interface or a two-wire interface serial bus.

In some embodiments, the comparison circuit is provided inside the first display driving circuit.

In some embodiments, the first display driving circuit is respectively connected to each second display driving circuit through a serial peripheral interface or a two-wire interface serial bus.

In some embodiments, the power management circuit is connected to the display panel through a signal line interface.

In some embodiments, each display panel operates in a plurality of display frames, wherein each display frame includes a display period and an idle period.

In some embodiments, the driving circuit is utilized to perform following tasks:

collect brightness level statistics of a subsequent display frame;

determine an associated cathode voltage;

determine an associated target value and adjust the cathode voltage of the display panel in accordance with the associated target value during an associated idle period that is after the display period of a present display frame and before the display period of the subsequent display frame.

In another aspect, a display panel driving system is provided, the system including:

a display panel having a plurality of panel partitions, wherein the display panel is an organic light-emitting diode display panel;

a plurality of display driving circuits operatively connected to each of the plurality of panel partitions;

a driving circuit, the driving circuit further comprising:

a plurality of display driving circuits each of the panel partitions having an associated display driving circuit in a one-to-one ratio;

a comparison circuit;

a power management circuit being connected to the comparison circuit and the display panel; wherein the comparison circuit is respectively connected to each of the display driving circuits;

each display driving circuit is utilized to collect brightness level statistics associated with each associated display panel partitions driven thereby;

each display driving circuit is configured to determine an associated cathode voltage value associated with its particular display panel partition driven thereby and transmit the associated cathode voltage value to the comparison circuit;

the comparison circuit is utilized to compare each associated cathode voltage value for each of the panel partitions and determine a target value which is then utilized to adjust the cathode voltage of the whole display panel; and the comparison circuit is utilized to transmit the target value to the power management circuit.

In some embodiments, the comparison circuit is utilized to determine a target value according to the minimum cathode voltage value among a plurality of cathode voltage values received.

In some embodiments, the power management circuit is utilized to transmit the target value received to the display panel, such that the cathode voltage value of the display panel can be adjusted according to the target value.

In some embodiments, the brightness level statistics is obtained by:

in accordance with the pixel grayscale values, statistically calculating minimum voltage differences required for each gray level.

In some embodiments, the brightness level statistics is further obtained by:

transmitting a black picture to the display panel;

measuring display brightness of the black picture;

adjusting the cathode voltage values of the display incrementally; and determining the minimum voltage differences that would not affect the display brightness.

In some embodiments, the brightness level statistics is further obtained by learning a correspondence between brightness and voltage difference.

In the driving circuit, the display device, and driving method thereof according to embodiments of the present disclosure, the driving circuit can be utilized to drive the OLED display panel that has at least two panel partitions, the driving circuit can include a plurality of display driving circuits that respectively drive at least two display panel partitions one-to-one.

Accordingly, the configuration of the comparison circuit that can be respectively connected to the aforementioned at least two display driving circuits in the driving circuit, after the comparison circuit determines the cathode voltage value (ELVss) upon receiving the brightness level statistics from each display driving circuit which collects the brightness level statistics of the panel partition it drives, the comparison circuit can compare the plurality of cathode voltage values and determine a target value that can be utilized to adjust the cathode value of the whole display panel according to the result of the comparison, as a result, the purpose of dynamic adjustment of the cathode voltage value of the whole display panel is achieved.

In the driving circuit of some embodiments of the present disclosure, in accordance with the configuration of a comparison circuit that can be connected to each display driving circuit, and in accordance with the comparison of cathode voltages determined by each display driving circuit can be achieved, the cathode voltage value of the whole display panel can be dynamically adjusted in accordance with the target value, the following problem in existing technologies is thus solved.

BRIEF DESCRIPTION OF DRAWINGS

To more clearly illustrate some of the embodiments, the following is a brief description of the drawings.

The drawings in the following descriptions are only illustrative of some embodiments. For those of ordinary skill in the art, other drawings of other embodiments can become apparent based on these drawings.

DETAILED DESCRIPTION

Figure 1:
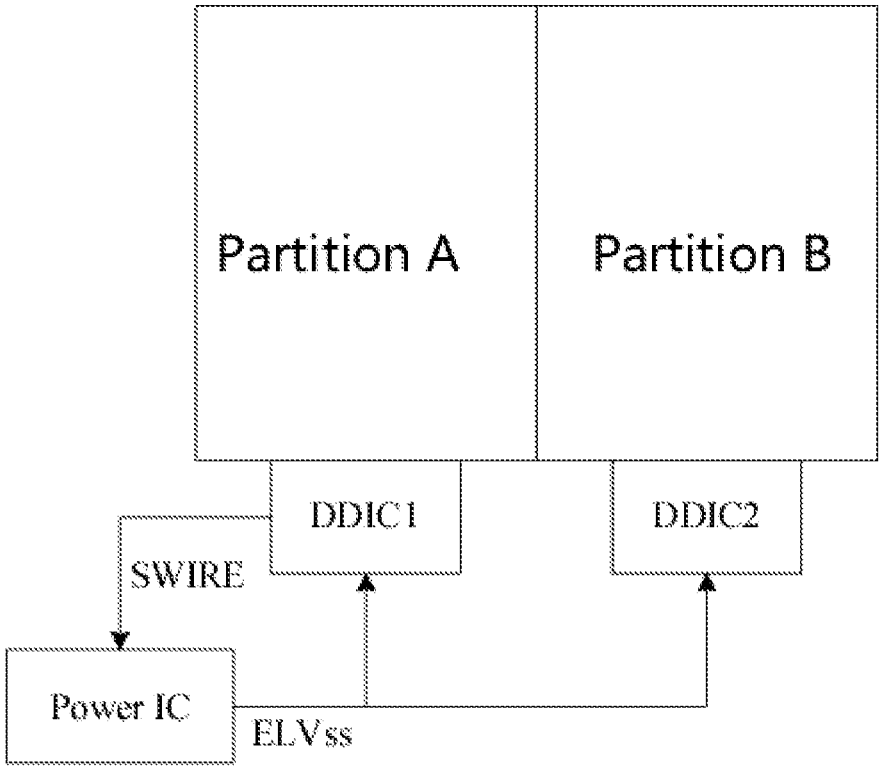
FIG. 1 illustrates a schematic structural view of a display panel driven by a plurality of DDIC chips for purposes of illustrating contextual scenarios in which the various aspects of the present disclosure can be employed.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or other structure is referred to as being "on" or extending "onto" another element, it can be directly on or extend directly onto the other element or intervening elements may also be present. In contrast, when an element is referred to as being "directly on" or extending "directly onto" another element, there are no intervening elements present.

Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

It will also be understood that when an element is referred to as being "connected" or "coupled" to another element, it can be electrically connected or coupled to the other element, for example through one or more wires, one or more other electrical components, wirelessly, or directly connected or coupled.

Relative terms such as "below" or "above" or "upper" or "lower" or "horizontal" or "horizontal" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Various embodiments of the present disclosure provide a driving circuit, a display device, and driving method thereof, in the application scenarios in which an OLED display panel is driven by a combination of DDIC chips, the brightness level statistics of the whole display panel can be collected, the dynamic ELVss adjustment function can be performed and the power consumption of the OLED component can be reduced.

With the continuous increase of the size of OLED products, it becomes more and more important to reduce power consumption. FIG. 1 is a schematic structural view of a display panel driven by a plurality of DDIC chips included for purposes of context for scenarios in which the methods and systems of the present invention can be employed.

As shown in FIG. 1, DDIC1 drives division A of the display panel, DDIC 2 drives division B of the display panel, dynamic ELVss adjustment requires collecting brightness level statistics of the whole screen, i.e. the whole display panel and determining a suitable ELVss as the cathode voltage of the OLED component in the display panel. However, for prior art applications and scenarios in which a display panel is driven by a combination of DDIC chips the dynamic ELVss adjustment function cannot be performed.

For example, in the particular application scenario shown in FIG. 1, the power supply architecture of prior art applications is generally provided as follows: the DDIC 1 is connected to the power IC through a signal wire (SWIRE) interface, but because SWIRE is an interface protocol in which the output voltage value is controlled through the number of pulses sent, the output of Power IC is provided to DCIC 1 and DDIC 2.

For the architecture in which two DDIC chips are combined to drive a display panel, when conducting ELVss adjustment, DDIC 1 collects statistics of division A to obtain an ELVss value, however, this ELVss value might not be suitable for division B, if the whole screen is adjusted in accordance with this ELVss value, there will be a difference between the brightness level of division A and the brightness level of division B.

Therefore, in existing technologies, for a display panel that is driven by two or more DDIC chips, the dynamic ELVss adjustment function cannot be performed, as a result, the brightness and thus the power consumption of the display panel cannot be reduced without causing display inconsistencies between the various divisions.

Figure 2:
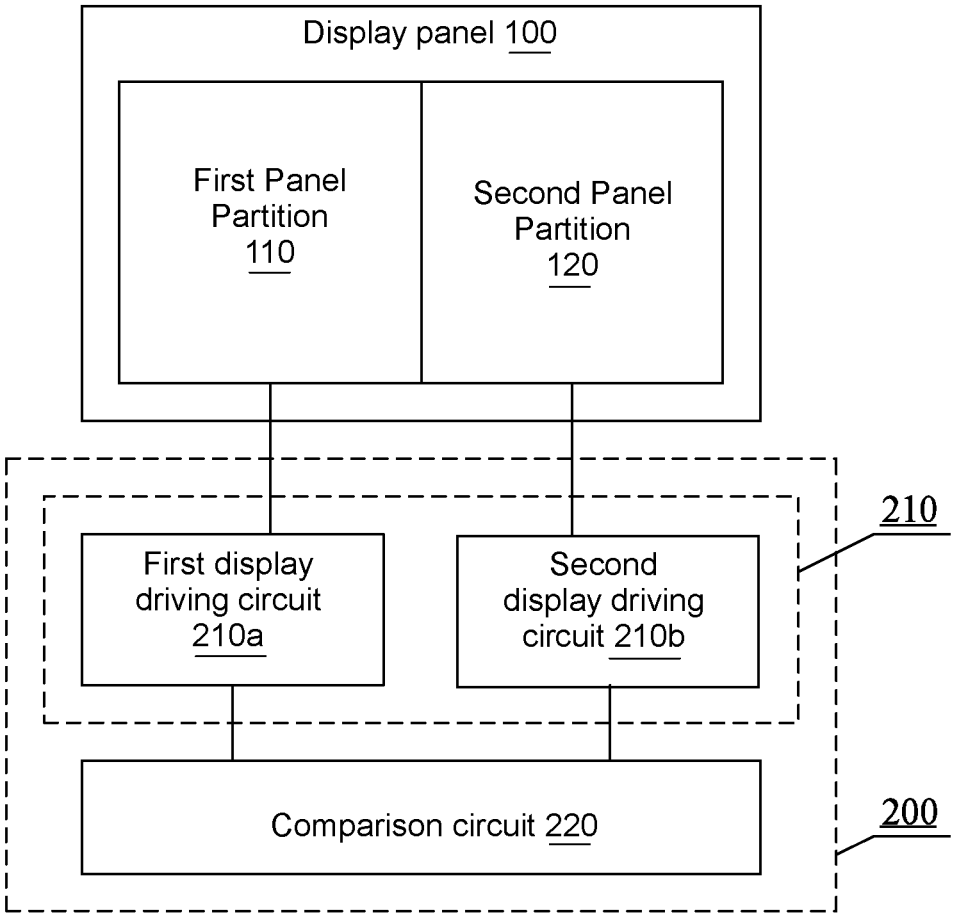
FIG. 2 illustrates an exemplary alternative a schematic structural view of a driving circuit according to some embodiments of the present disclosure.

In order to solve these deficiencies an alternative driving method and system is contemplated herein, and as illustrated in FIG. 2, which depicts a schematic structural view of a driving circuit according to some embodiments of the present disclosure which allow for brightness and cathode voltage detection which will allow for brightness adjustment and reduction of power consumption thereby. The driving circuit 200 of these embodiments can be utilized to drive the OLED display panel that has at least two panel partitions to display.

In these embodiments, the driving circuit 200 can include: display driving circuits 201 that respectively drive at least two panel partitions in a one-to-one ratio, and a comparison circuit 220, wherein, the comparison circuit 220 can respectively be connected to each display driving circuit 210.

In the embodiments contemplated herein, each display driving circuit 210 can then be utilized to obtain brightness level statistics of the particular associated panel partition it drives, determine a cathode voltage for the associated panel, and transmit the cathode voltage associated therewith to the comparison circuit 220.

The comparison circuit 220 can then be utilized to compare the plurality of cathode values received and determine a target value which can then be utilized to adjust the cathode voltage of the display panel 100 according to the result of the comparison.

The driving circuit 200 according to some embodiments of the present disclosure can be utilized to drive the OLED display panel 100, the OLED display panel 100 having at least two panel partitions to display.

In other words, the driving circuit 200 can be included within the OLED display panel, the light-emitting structure (OLED component) of the OLED display panel 100 can then include: cathodes, an electron injection layer (EIL), an electron transport layer (ETL), a light-emitting layer (EL), a hole transport layer (HTL), a hole injection layer (HIL) and various anodes. In practical applications, the driving circuit 200 can be integrated into a driving chip.

Further, the comparison circuit 200 and the at least two display driving circuits 210 that are connected to the comparison circuit 220 can then be provided inside the driving chip.

In some additional embodiments, the comparison circuit 220 and each display driving circuit 210 can be independently provided inside different chips. For example, the comparison circuit 220 can be provided inside a processing chip, wherein each display driving circuit 210 can be respectively provided inside a DDIC chip. In some such embodiments, a hardware structure can be provided in which the processing chip is respectively connected to each DDIC chip. As such, these chips, and their connection structures, form the whole structure of the driving circuit 200.

The display panel 100 as shown in FIG. 2 can include two panel partitions. The two panel partitions can be, for example, a first panel partition 110 and a second panel partition 120. As illustrated here, the display panel 100, which has two panel partitions, the driving circuit 200 will then include a first display driving circuit 210*a* that drives the first panel partition 110 and a second display driving circuit 210*b* that drives the second panel partition 120. It will then be appreciated that the display panel 100 can also include more than two panel partitions, and the driving circuits 200 can also include more than two display driving circuits 210, which are merely discussed as first and second so as to illustrate a plurality thereof.

The at least two display driving circuits 210 and the at least two panel partitions correspond to each other in a one-to-one ratio. In such embodiments, each display driving circuit 210 can conduct operations related to display driving to the panel partition it drives, but can also collect brightness level statistics of the panel partition it drives and determine the cathode voltage value (ELVss) corresponding to the panel partition according to the brightness level statistics collected.

In the application scenario shown in FIG. 2, the first display driving circuit 210*a* can collect brightness level statistics of the first panel partition 110 in order to obtain the first cathode voltage value ELVss1. Additionally, the second display driving circuit 210*b* can collect brightness level statistics of the second panel partition 120 in order to obtain the second cathode voltage value ELVss2.

Then, the first display driving circuit 210*a* and the second display driving circuit 210*b* can respectively transmit the cathode voltage value statistics they obtained to the comparison circuit 220.

Accordingly, after the comparison circuit 220 receives the first cathode voltage value ELVss1 sent by the first display driving circuit 210*a* and the second cathode voltage value ELVss2 sent by the second display driving circuit 210*b*, the comparison circuit 220 can compare the two cathode voltage values and determine a target value according to the result of the comparison.

For the OLED display panel 100, during a displaying stage, the drive thin film transistor (DTFT) of the OLED component is required to work within a saturation region. in order for the DTFT to work at the saturation region, the difference between the working voltage of the OLED component (ELVdd) and the cathode voltage (ELVss) of the OLED needs to be larger than a certain value, i.e. a minimum critical value, if the difference in voltage is smaller than the minimum critical value, the DTFT will work within a linear region.

Then if the working condition of the OLED component is not satisfied, for example, the determined ELVss1 of the first panel partition 110 is −3, the determined ELVss2 of the second panel partition 120 is −4, then, the cathode voltage value that satisfies the condition that the two panel partitions will work normally is −4. In this manner the normal display state of the whole display panel can be ensured.

It will then be understood, that the abovementioned target value determined is the cathode voltage value that can be utilized to adjust the cathode voltage of the whole display panel 100. In this manner, dynamic adjustment of the cathode voltage of the whole display panel 100 in accordance with the target value can ensure normal display of the display panel 100.

It should be noted, there are no limitations to the number of panel partitions in the display panel 100, and there are no limitations to the number of display driving circuits 210, as illustrated in FIG. 2, the display panel 100 that includes two panel partitions and two display driving circuits 210 is only made by way of an example.

In practical applications, the display panel 100 can include three, four or more panel partitions, wherein the number of display driving circuits will increase such that the number of the panel partitions, the panel partitions, and the display driving circuits correspond to each other in a one-to-one ratio, such that each display driving circuit 210 drives an associated panel partition.

According to embodiments of the present disclosure, based on the hardware architecture in which the comparison circuit 220 that can communicate with each display driving circuit 210 is provided inside the driving circuit 200, the display driving circuit 210 in the driving circuit 200. With this configuration, each display driving circuit 210 can collect brightness level statistics of the panel partition it drives, in contrast to existing technologies wherein brightness level statistics can only be collected by the DDIC1 that is connected to the Power IC through the SWIRE, because the DDIC1 can only collect brightness level statistics of the division A, the ELVss value obtained can only be applied to dynamic adjustment of the cathode voltage of the division A, if the whole display panel (including division A and division B) is adjusted in accordance with this ELVss value, it is possible there will be a difference in brightness level for division A and division B after the adjustment, as a result, the display performance of the display device might be negatively influenced.

Compared with existing technologies, in embodiments of the present disclosure, based on the structure that the comparison circuit 220 can communicate with each display driving circuit 210 so as to collect brightness data or values. In accordance with this principle, each display driving circuits 210 within the driving circuit 200 can be provided which can perform the following steps: collecting brightness level statistics of the panel partition each display driving circuit 210 drives in order to obtain the cathode voltage value corresponding to each panel partition, and transmitting the cathode voltage value to the comparison circuit 220 respectively obtained by the display driving circuits 210 through the communication capability between the display driving circuits 210 and the comparison circuit 220. In other words, the comparison circuit 220 can compare and analyze the plurality of cathode voltage values received to obtain a cathode voltage value, e.g. the target value that can be applied to all panel partitions, the cathode voltage of the whole display panel 100 can be adjusted in accordance with the target value. As a result, the purpose of reducing power consumption of the display panel 100 is achieved.

The driving circuit according to embodiments of the present disclosure can be utilized to conduct display driving to the OLED display panel that has at least two panel partitions, the driving circuit can include a plurality of display driving circuits corresponding to a corresponding plurality of panel partitions of the display panel in a one-to-one ratio.

A comparison circuit can then be provided in each driving circuit, which can be respectively connected to the each of the display driving circuits. After the comparison circuit determines the cathode voltage value (ELVss), upon receiving the brightness level statistics of the panel partitions provided by the display driving circuits, the comparison circuit can then also compare the plurality of cathode voltage values received and determine a target value for adjusting the cathode voltage of the whole display panel according to the result of the comparison.

In this manner, dynamic adjustment of the cathode voltage value of the whole display panel can be realized. Through the configuration of the comparison circuit that is connected to each display driving circuit, the driving circuit of the present disclosure can realize the comparison of the cathode voltage value determined respectively by each display driving circuit, therefore, in accordance with a target value, the cathode voltage value of the whole display panel can be then be adjusted dynamically.

As a result, the problem in existing technologies with regard to brightness level statistics can be solved by measuring each of the brightness levels and cathode voltages for each panel partition.

In particular, the brightness level can be determined in accordance with the grayscale value of each pixel. In accordance with the measurement, the minimum voltage difference required for each gray level can be statistically calculated. For example, the display can have a black picture transmitted thereto, wherein the brightness of the display while displaying the black picture can be measured. Then the voltage can be adjusted incrementally and a minimum voltage difference which would not affect the display brightness can be determined.

As the measured brightness increases incrementally with various grayscale levels of the image transmitted, a corresponding voltage can be associated therewith and used in future display functions. In some instances, the correspondence between brightness and voltage difference can be calculated and extrapolated in accordance with the previously measured or learned values prior to displaying the image.

In some embodiments of the present disclosure, the method of determining a target value by the comparison circuit 220 can include a step of utilizing the comparison circuit 220 so as to determine a minimum cathode voltage value among the plurality of cathode voltage values received as a target value.

According to some embodiments of the present disclosure, for the OLED display panel 100, when the OLED component is displaying, it requires the DTFT to be working in a saturation region. In this case, the electric current of the OLED component will not change as the voltage difference between the working voltage, ELVdd, of the OLED component and the ELVss changes.

In such an instance, the minimum voltage difference has the best power-saving effect. It will also be understood that the display picture of different brightness level will influence this voltage difference, and when the brightness value is minimized, the corresponding voltage difference required is also minimized.

Therefore, determining the minimum voltage difference should be based on display picture. In addition, the voltage difference calculated according the ELVss determined by each display driving circuit 210 is the minimum voltage difference that can satisfy the condition that the panel partition that each display driving circuit drives will display normally.

In other words, after adjusting the ELVss of the whole display panel, the voltage difference between any two-panel partition should not be smaller than the aforementioned minimum voltage difference required for normal operation.

Therefore, each display driving circuit 210 can collect brightness level statistics of each associated panel partition driven by each display driving circuit, and thus determine the minimum voltage difference for normal operation.

In other words, after the comparison of the cathode voltage value determined by each display driving circuit 210, the minimum cathode voltage value necessary for normal operation will be determined as the target value for adjusting the cathode voltage of the whole display panel 100, as a result, the power consumption of the display panel 100 can be reduced.

Figure 3:
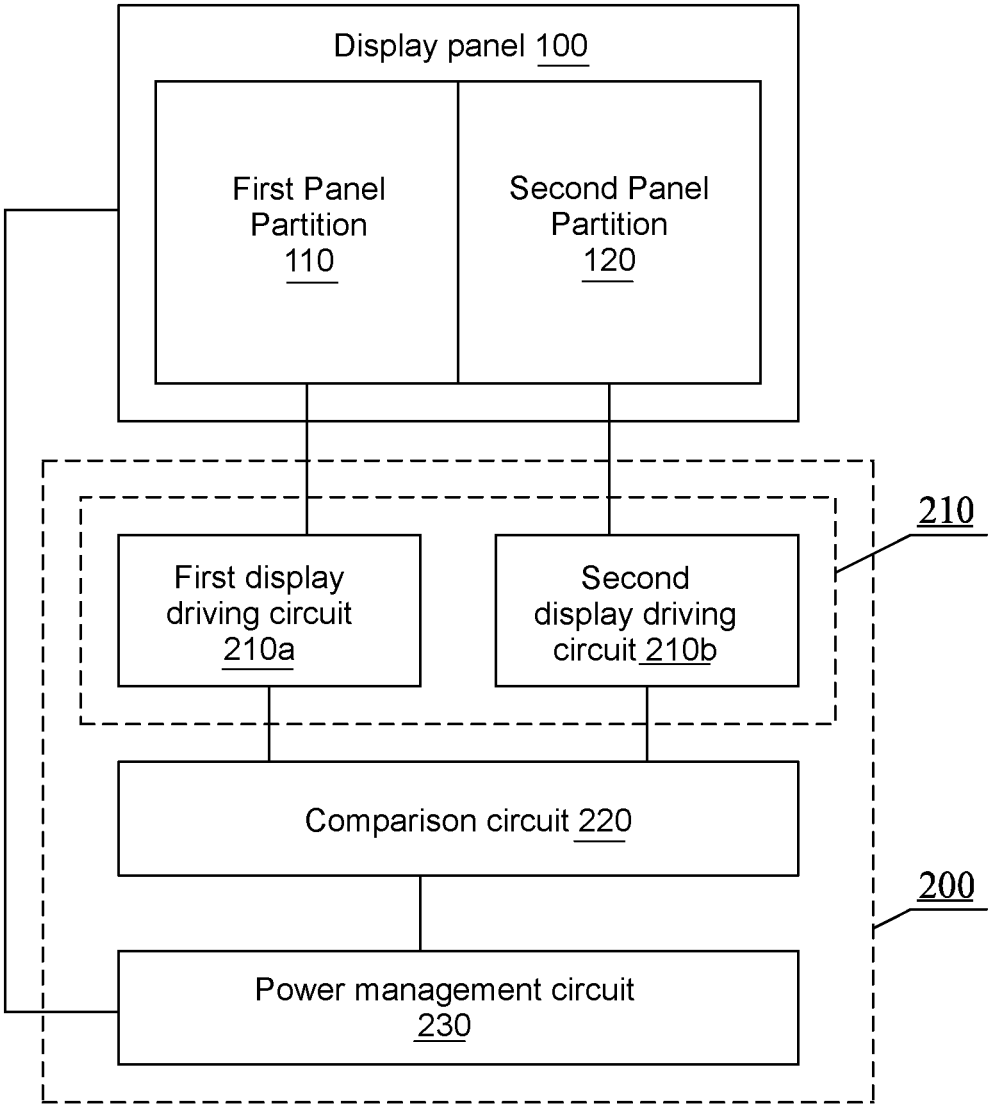
FIG. 3 illustrates an exemplary alternative a schematic structural view of another driving circuit according to some other embodiments of the present disclosure.

FIG. 3 is a schematic structural view of another driving circuit according to some other embodiments of the present disclosure. On the basis of the driving circuit 200 as illustrated in FIG. 2, the driving circuit 200 can further include: a power management circuit 230 that can be respectively connected to the comparison circuit 220 and the display panel 100.

In some embodiments of the present disclosure, the comparison circuit 200 can further be utilized to transmit the target value it determines to the power management circuit 230.

The power management circuit 230 can then be utilized to transmit the target value received to the display panel 100, such that the cathode voltage of the display panel 100 can be adjusted in accordance with the target value.

In some embodiments of the present disclosure, the comparison circuit 220 can be provided within a driving circuit 200 and then be configured so as to determine a target value that can be utilized to adjust the cathode voltage of the whole display panel 100, including each panel partition in the display panel 100, in this manner the cathode voltage values van be obtained from the plurality of display driving circuits 210. In practical applications, generally, the power management circuit 230, for example, a Power IC, can be utilized to conduct dynamic ELVss adjustment to the display panel 100.

Then, the comparison circuit 220 can send the target value to the power management circuit 230 through a SWIRE interface. The power management circuit 230 can then send the target value to the whole display panel 100, and the display panel 100 can conduct a cathode voltage adjustment passively in accordance with the target value received. As a result, dynamic adjustment of the cathode voltage value can be achieved.

Similar to the abovementioned embodiments, the driving circuit 200 can be entirely provided in a driving chip, the driving chip can include each circuit shown in the structure of FIG. 3. Specifically, the driving circuit can include a plurality of display driving circuits 210, the comparison circuit 220 and the power management circuit 230.

These circuits can then be utilized satisfy the abovementioned connection relationship. Or in other words, each circuit in the driving circuit 200 in FIG. 3, e.g., the plurality of display driving circuit 210, the comparison circuit 220 and the power management circuit 230 can each be provided independently in a chip. For example, the comparison circuit 220 can be provided in a processing chip, each display driving circuit 210 can be provided in a DDIC chip, the power management circuit 230 can be provided in a Power IC chip, and these chips along with their connection structures can be combined so as to form the whole structure of the driving circuit 200.

Figure 4:
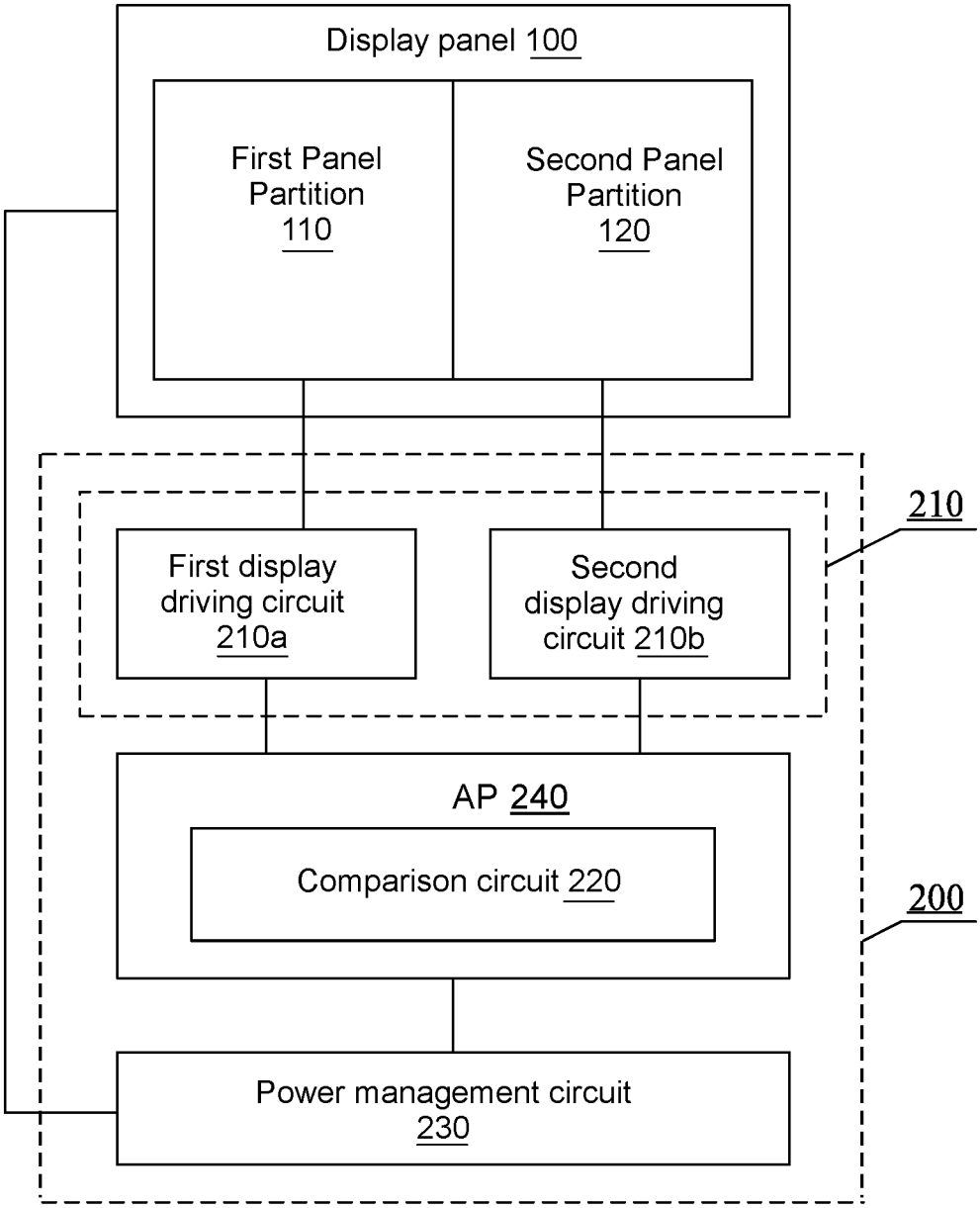
FIG. 4 illustrates an exemplary alternative a schematic structural view of yet another driving circuit according to yet some other embodiments of the present disclosure.

In some embodiments of the present disclosure, and as shown in FIG. 4, contemplates another alternative driving circuit, in the driving circuit 200 shown in FIG. 4, a comparison circuit 220 can be independently provided outside all display driving circuit 210.

As an example, the illustration of FIG. 2 is based on the structure of the display device shown in FIG. 3, wherein the display panel 100 can include a first panel partition 110 and a second panel partition 120. The driving circuit 200 can then include a first display driving circuit 210*a* that drives a first panel partition 110 and a second display driving circuit 210*b* that drives a second panel partition 120.

In some embodiments of the present disclosure, each display driving circuit 210 can be connected to the comparison circuit 220 through a serial peripheral interface (SPI) or an inter-integrated circuit (I2C). In other words, each display driving circuit 210 can transmit the cathode voltage value it determines to the comparison circuit 220 through the aforementioned SPI or I2C interface.

As shown in FIG. 4, for example, the comparison circuit 220 can be provided in an application processor 240 (AP). The AP 240 can then realize all functions of the comparison circuit 220, for example, comparing the plurality of cathode voltage values after it receives the cathode voltage value transmitted from each display driving circuit 210, determining a target value, sending the target value to the power management circuit 230 through the SWIRE interface, then, the power management circuit 230 can transmit the target value that can be utilized to dynamically adjust the cathode voltage of the display panel 100 to the display panel 100.

Figure 5:
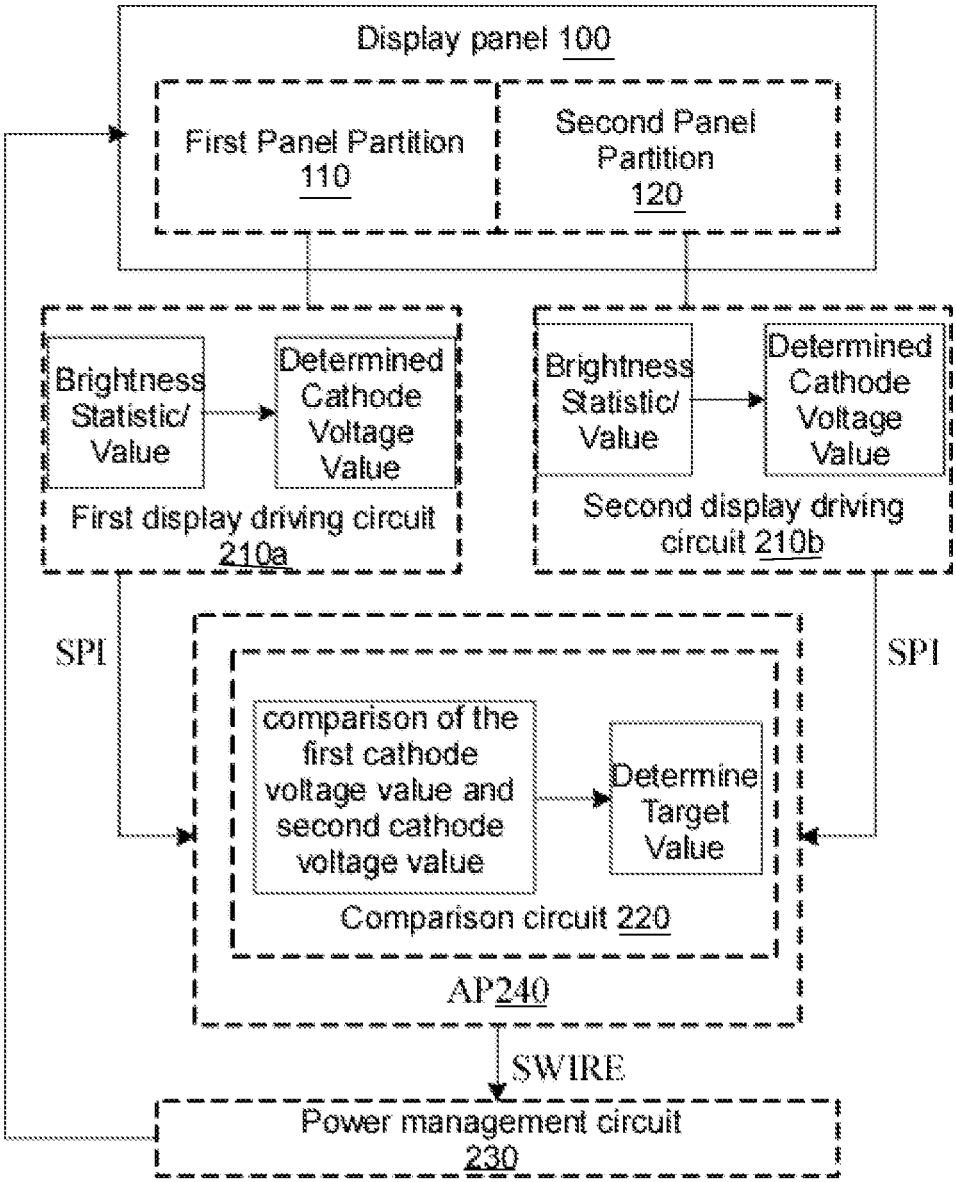
FIG. 5 illustrates an exemplary alternative a working principle diagram of dynamic adjustment of the cathode voltage value of a display panel conducted by a driving circuit of FIG. 4.

As shown in the FIG. 5, contemplated and illustrated herein are various principle and a schematic thereof of a dynamic adjustment of the various cathode voltages of a display panel as performed by a driving circuit of FIG. 4. In this embodiment, the first display driving circuit 201 can be connected to the first panel partition 110, such that it can be utilized to collect brightness level statistics of the first panel partition 110 and determine the first cathode voltage. The second display driving circuit 210*b* can then be connected to the second panel partition 120, such that it can be utilized to collect brightness level statistics of the second panel partition 120 and determine the second cathode voltage value.

The comparison circuit 220 can be provided inside the AP 240, the first display driving circuit 210*a* and the second display driving circuit 210*b* can be respectively connected to AP 240 through SPI, the AP 240 can be connected to the power management circuit 230 through SWIRE interface. The power management circuit 230 can be connected to the display panel 100, based on the aforementioned connection relationship between the driving circuit 200 and the display panel 100.

In this manner, the first display driving circuit 210*a* and the second display driving circuit 210*b* can respectively transmit the first cathode voltage value determined by the first display driving circuit 210*a* and the second cathode voltage value determined by the second display driving circuit 210*b* to the AP 240. The AP 240 can compare the first cathode value and the second cathode value received, and determine the target value for adjusting the cathode voltage value of the whole display panel.

The AP 240 can then transmit the determined target value to the power management circuit 230 through the SWIRE interface, and the power management module 140 can transmit the target value to the whole display panel 100 to so as to perform dynamic adjustment of the cathode voltage value.

Figure 6:
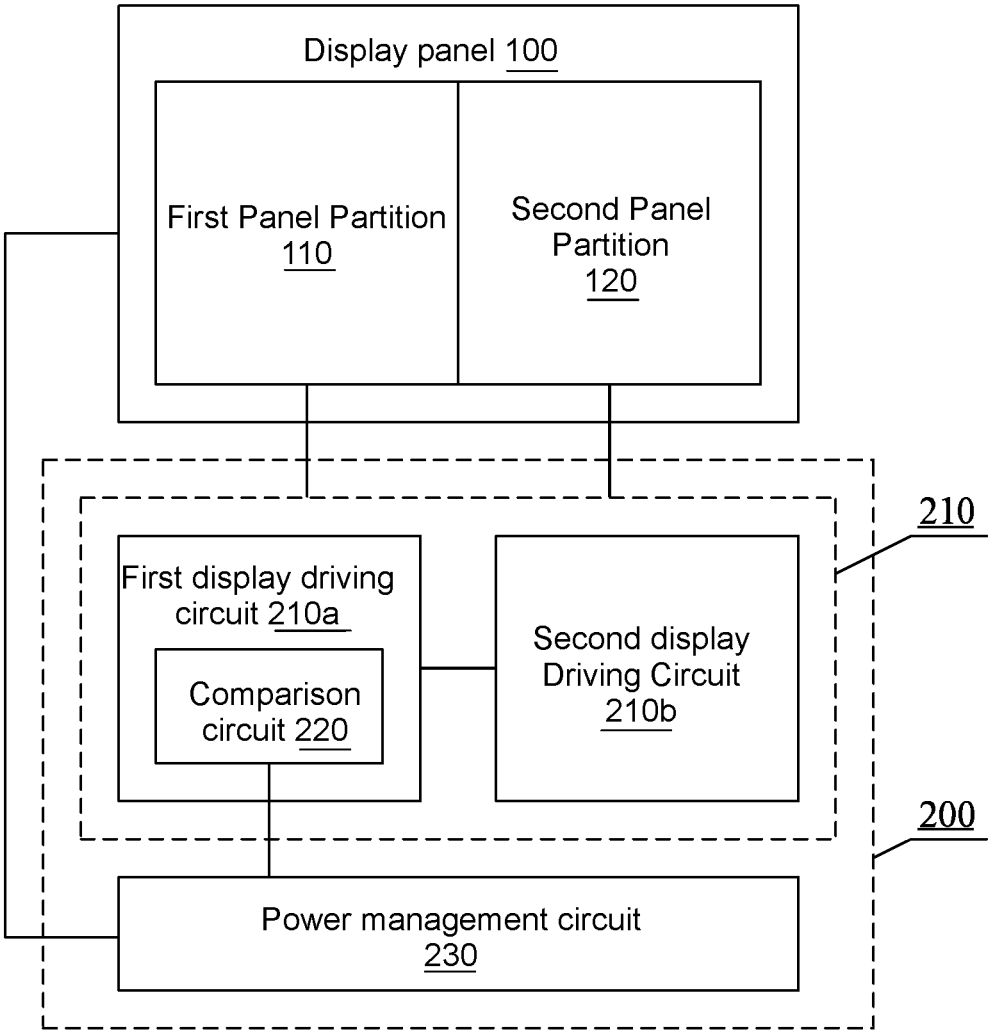
FIG. 6 illustrates an exemplary alternative a schematic structural view of yet another driving circuit according to yet some other embodiments of the present disclosure.

In some other embodiments of the present disclosure, as shown in FIG. 6, which is a schematic structural view of yet another driving circuit according to yet some other embodiments of the present disclosure, the display panel can include a first panel partition 110 and at least one second panel partitions 120.

Accordingly, the display driving circuit 210 can include a first display driving circuit 210*a* and at least one second display driving circuits 210*b*, and a comparison circuit 220 can be provided inside a first display driving circuit 210*a*. It should be noted, the first panel partition 110 is different from other panel divisions, other panel partitions refer to the at least one second panel partitions 120, specifically, the comparison circuit 200 can be provided inside the first panel partition, wherein the first display driving circuit 210*a* can be provided so as to drive the first panel partition 110.

The panel partitions shown herein which are not provided with comparison circuit 220 are referred to as the second panel partitions 120. The number of the second panel partition 120 can be one or more than one, wherein the number of the second display driving circuits 210*b* should correspond in number to the number of second panel partitions 120, wherein each second panel partition 120 should have an associated second display driving circuit 210*b*, wherein they correspond to each other in a one-to-one ratio.

It should be noted, in FIG. 6, as an example, the comparison circuit 220 is provided inside the first display driving circuit 210*a*. However, the comparison circuit 220 can be provided inside any one of the display driving circuits 210 of the driving circuit 200, other display driving circuits that are not provided with the comparison circuit 220, which can be referred to as slave display driving circuits, are respectively connected to the display driving circuit, which can be referred to as a master display driving circuit, which is provided with the comparison circuit 220.

The master display driving circuit can compare a plurality of cathode voltage values, determine a target value, and transmit the target value to the power management circuit 230.

The illustration of the driving circuit 200 in FIG. 6 is also based on the structure of the display device of FIG. 3, in other words, the number of the second panel partitions 120 and the number of the second display driving circuits 210*b* are both one. In this embodiment, the display panel 100 includes the first panel partition 110 and the second panel partition 120.

The display driving circuit 210 can then include the first display driving circuit 210*a* that drives the first panel partition 110 and the second display driving circuit 210*b* that drives the second panel partition 120, and the comparison circuit 220 can then be provided inside the first display driving circuit 210*a*.

In some embodiments of the present disclosure, the first display driving circuit 210*a* can be respectively connected to each second display driving circuit 210*b* through SPI or I2C. In this manner, the cathode voltage value determined by each second display driving circuit can be transmitted to the comparison circuit 220 inside the first display driving circuit 210*a* through SPI or I2C.

As shown in FIG. 6, in some embodiment of the present disclosure, the comparison circuit 220 can be specifically provided inside the first display driving circuit 210*a*, and a communication module can be added to the two display driving circuits 210.

For example, SPI or I2C can be utilized so as to connect the two display driving circuits 210, wherein the cathode voltage value which is determined by the second display driving circuit 210*b* can be transmitted to the first display driving circuit 210*a* through SPO or I2C.

In some such embodiments, all functions realized by the comparison circuit 220 can be executed by the first display driving circuit 210*a*. In this exemplary embodiment, the display driving circuit can then compare the cathode voltage values determined by all the display driving circuits 210 inside the first display driving circuit 210*a*, determine a target value, transmit the target value to the power management circuit 230 through the SWIRE interface, then, the power management circuit 230 can transmit the target value that can be utilized to dynamically adjust the display panel 100 to the display panel 100.

Figure 7:
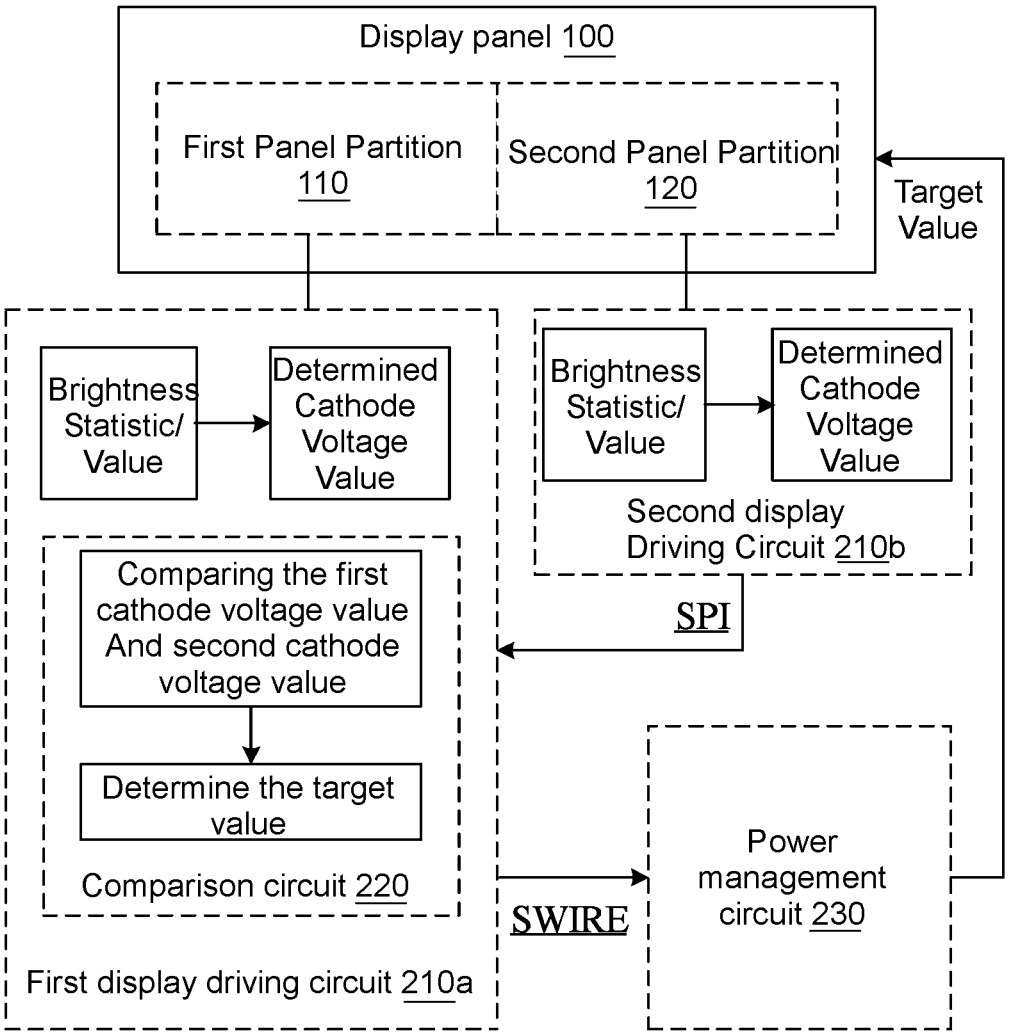
FIG. 7 illustrates an exemplary alternative a working principle diagram of dynamic adjustment of the cathode voltage value of a display panel conducted by a driving circuit of FIG. 6.

As shown in FIG. 7, which is an exemplary conceptual diagram of a method of providing dynamic adjustment of the cathode voltage of a display panel conducted by the driving circuit of FIG. 6.

In this embodiment, the first display driving circuit 210*a* can be connected to the first panel partition 110, the first display driving circuit 210A can then be utilized to collect brightness level statistics of the first panel partition 110 and determine the first cathode voltage value.

The second display driving circuit 210*b* can then be connected to the second panel partition 120, wherein the second display driving circuit 210*b* can be utilized to collect brightness level statistics of the second panel partition 120 and determine the second cathode voltage value.

The comparison circuit 220 can then in this instance be provided inside the first display driving circuit 210*a*, wherein the second display driving circuit 210*b* can be connected to the first display driving circuit 210*a* through SPI.

In this embodiment, the first display driving circuit 210*a* can be connected to the power management circuit 230 through SWIRE interface, the power management circuit 230 can be connected to the display panel 100, based on the abovementioned connection relationship of the driving circuit 200 and the display panel 100, the second display driving circuit 210*b* can transmit the second cathode voltage value it determined to the first display driving circuit 210*a*.

In addition, the first display driving circuit 210*a* can utilize the first cathode voltage value determined internally, and the first display driving circuit 210*a* can compare the first cathode voltage value and the second cathode voltage value it received and determine the target value which can be utilized to adjust the cathode value of the whole display panel.

The first display driving circuit 210 can then transmit the target value determined to the power management circuit 230, the power management module 140*n* can transmit the target value to the whole display panel 100 so as to perform dynamic adjustment of the cathode voltage value.

The second display driving circuit 210*b* can transmit the second cathode voltage it determines to the first display driving circuit 210*a*, in addition, the first display circuit 210*a* can have the first cathode voltage value determined by itself, the first display driving circuit 210*a* can compare the first cathode value and the second cathode value it receives to determine the target value that can be utilized to adjust the cathode voltage of the whole display panel 100, the first display driving circuit 210*a* can transmit the target value determined to the power management circuit 230 through the WIRE interface, and the power management module 140 can transmit the target value to the whole display panel 100 to conduct dynamic adjustment of the cathode voltage value.

Figure 8:
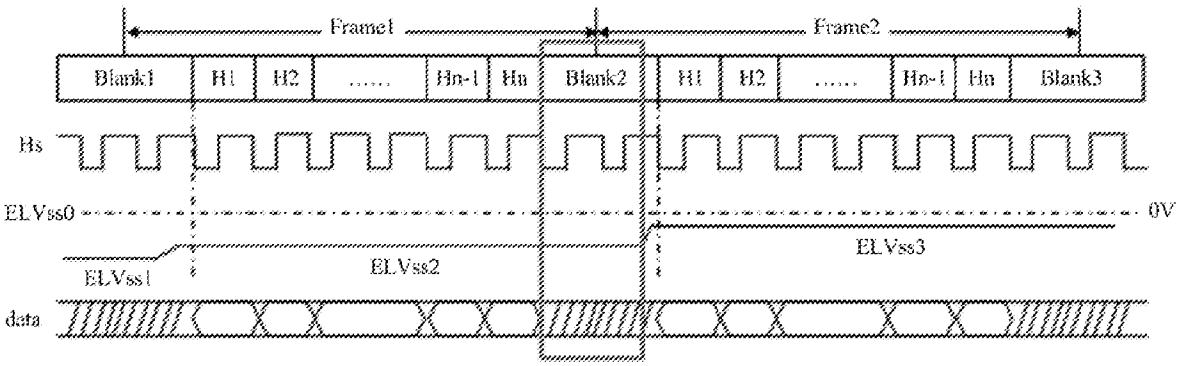
FIG. 8 illustrates an exemplary alternative a sequence diagram of the displaying of an OLED display panel conducted by a driving circuit according to some embodiments of the present disclosure.

In some embodiments of the present disclosure, FIG. 8 is a time sequence diagram for display driving of an OLED display panel conducted by a driving circuit according to some embodiments of the present disclosure.

As shown in FIG. 8, each display frame of the display panel 100 can include a display period and an idle period, wherein the display period can include H1, H2 . . . , Hn−1, Hn. It will then be understood that the idle period between any adjacent display frames can be blank. For example, the idle period before the first display frame, i.e. Display frame 1, can be Blank 1, and subsequently the idle period between the first display frame Display frame 1 and the second display frame, i.e. Display frame 2, can be Blank 2, and similarly, the idle period after the second display frame Display frame 2 can be Blank 3, as such in FIG. 8, HS represents the pulse period of horizontal scanning (HS).

In some embodiments of the present disclosure, the driving circuit 200 can be utilized to collect brightness level statistics, determine the cathode voltage, determine a target value and adjust the cathode voltage of the display panel 100 in accordance with the target value during the idle period after the display period of the present display frame and the display period of the next display frame.

From the time sequence diagram of FIG. 8, it can be seen, data transmission can be executed during the display period of each display frame, the dotted line in FIG. 8 represents reference cathode voltage value (ELVss0), which can be OV.

Further, the cathode voltage value (ELVss1) of the display frame before Blank 1, the cathode voltage value (ELVss2) of the display frame after Blank 1 and the cathode voltage value (ELVss3) of the display frame after Blank 2 can be different. In other words, the cathode voltage of the display panel 100 can be adjusted dynamically by the driving circuit 200 during display driving process.

Based on the displaying time sequence factor of the display panel 100, e.g., each display frame can include a display period and an idle period, the order of each operation executed by the driving circuit 200 for any of the aforementioned embodiments of the present disclosure can be determined, there can be an idle period between the display period of each display frame, during the idle period after completing the display of the present display frame and before the display period of the next display frame, the display panel 100 can obtain the display data information transmitted by AP, the display data information is the data information of the next display frame, during the idle period, each operation for any of the aforementioned embodiments of the present disclosure can be conducted during the idle period.

For example, the operations can include: each DDIC collecting the statistics of the data to be displayed of the next display frame of the panel partition it drives; determining the cathode voltage, wherein each DDIC transmits the data that represents cathode voltage to the comparison circuit 220 through SPI or I2C; utilizing the comparison circuit 220 to compare the cathode voltage values to determine a target value.

In other words, during the idle period, the ELVss value applicable for the next display frame can be determined before the arrival of the next display frame, and the ELVss value can be utilized to adjust the cathode voltage of the display panel 100.

In the comparison circuit 200 illustrated in FIG. 4 and FIG. 6, for the component in which the comparison circuit 220 is provided, regardless of whether it is an AP 240 or a first display driving circuit 210*a*, the comparison circuit 220 can communicate with the display driving circuits that can transmit cathode voltage values through SPI or I2C.

In the following, the feasibility of the communication between the comparison circuit 220 and each display driving circuit 210 according to embodiments of the present disclosure will be described in detail with the example in which the communication is SPI communication.

SPI can work through a master-slave mode, in this mode, usually, there is a master device, and one or more slave devices, at least four lines are required, however, it can be three lines in single-direction transmission. Common for SPI devices, the four lines are respectively SDI (data input), SDO (data output), SCL (clock) and CS (chip select).

(1) SDI is: Serial Data In;

(2) SDO is: Serial Data Out;

(3) SCL is: Serial Clock Signal, and is generated by the master device;

(4) CS is: Chip Select Signal, it is the slave device enabling signal, and is controlled by the master device.

Wherein, CS refers the control signal that controls whether the slave device is selected by the master device. In other words, only when the chip select signal is a preset enabling signal, i.e. high electrical potential or low electrical potential, the operation of the slave device by the master device can be effective. As a result, it is feasible to connect a plurality of devices through a SPI on a common bus.

For the three communication lines, communication can be realized through data exchange and SPI is a serial communication protocol. In other words, data is transmitted digital by digital, a SCL clock line is required, the SCL line can provide clock pulses, SDI and SDO can complete data transmission according to the clock pulses.

In practical applications, data output can be done through an SDO line, as such data can change during a rising edge of the clock or a falling edge of the clock, and data can be read during the next falling edge of the clock or rising edge of the clock. Thus, transmission of one digit of data can be completed; which can be the same for data input. As a result, at least eight times of clock signal change, are required for the transmission of eight digits of data wherein one time includes a rising edge and a falling edge.

Figure 9:
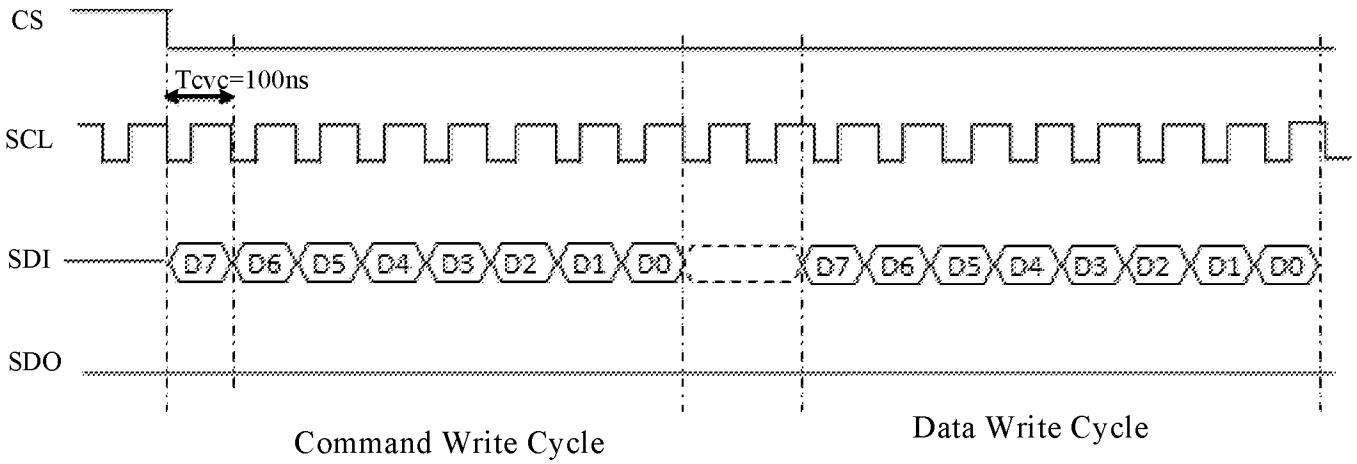
FIG. 9 illustrates an exemplary alternative a signal diagram of data transmission by a driving circuit according to some embodiments of the present disclosure.

FIG. 9 is a signal diagram of data transmission by a driving circuit according to some embodiments of the present disclosure, as illustrated in FIG. 9, "Tcvc" represents the period for inputting or outputting one digit of data, Tcvc, for example, can be 100 nanosecond (ns), the dotted line between the "command write cycle" and the "data write cycle" represents the idle period between two display frames.

In addition, the data transmission format of SPI is as follows: register address+data, an example of SPI data transmission format (e.g. data) is shown in the table 1 below.

TABLE 1

| bit/ rising edges | EL Vss | Digital-analogy conversion (DAC) value | bit/ rising edges | EL Vss | Digital-analogy conversion (DAC) value |
|---|---|---|---|---|---|
| 0/no pulse | −5.0 V | 000000 | 21 | −4.4 V | 010101 |
| 1 | −6.4 V | 000001 | 22 | −4.3 V | 010110 |
| 2 | −6.3 V | 000010 | 23 | −4.2 V | 010111 |
| 3 | −6.2 V | 000011 | 24 | −4.1 V | 011000 |
| 4 | −6.1 V | 000100 | 25 | −4.0 V | 011001 |
| 5 | −6.0 V | 000101 | 26 | −3.9 V | 011010 |
| 6 | −5.9 V | 000110 | 27 | −3.8 V | 011011 |
| 7 | −5.8 V | 000111 | 28 | −3.7 V | 011100 |
| 8 | −5.7 V | 001000 | 29 | −3.6 V | 011101 |
| 9 | −5.6 V | 001001 | 30 | −3.5 V | 011110 |
| 10 | −5.5 V | 001010 | 31 | −3.4 V | 011111 |
| 11 | −5.4 V | 001011 | 32 | −3.3 V | 100000 |
| 12 | −5.3 V | 001100 | 33 | −3.2 V | 100001 |
| 13 | −5.2 V | 001101 | 34 | −3.1 V | 100010 |
| 14 | −5.1 V | 001110 | 35 | −3.0 V | 100011 |
| 15 | −5.0 V | 001111 | 36 | −2.9 V | 100100 |
| 16 | −4.9 V | 010000 | 37 | −2.8 V | 100101 |
| 17 | −4.8 V | 010001 | 38 | −2.7 V | 100110 |
| 18 | −4.7 V | 010010 | 39 | −2.6 V | 100111 |
| 19 | −4.6 V | 010011 | 40 | −2.5 V | 101000 |
| 20 | −4.5 V | 010100 | 41 | −2.4 V | 101001 |

In table 1 above, "bit/rising edge" represents the number of pulses, e.g., data in SPI format, "digital-analogy conversion value" is binary data corresponding to "bit/rising edge", data represents the amount of data of ELVss.

In the driving circuit 200 according to embodiments of the present disclosure, each DDIC, e.g. display driving circuit 210, can respectively collect brightness level statistics of the panel partition it drives, determines the cathode voltage value, e.g. ELVss value, which is applicable for the corresponding panel partition, and communication function can be added to each IC.

For example, the communication mode in which AP terminal can respectively communicate with each DDIC can be adopted, or, the communication mode in which a certain DDIC can communicate with other DDIC can be adopted to realize the comparison of the ELVss value determined respectively by the plurality of DDIC, and the minimum ELVss value can be selected as the target value that can be utilized to adjust the cathode voltage of the whole display panel 100.

Finally, the Power IC, e.g. the power management circuit 230, can be controlled to output to the display panel 100, and in this manner dynamic adjustment of ELVss can thus be completed.

Based on the driving circuit 200 according to embodiments of the present disclosure, in another aspect of the present disclosure, a display device is provided, the display device according to embodiments of the present disclosure can include: an OLED display panel that has at least two panel partitions, and a driving circuit 200 according to any one of the embodiments of the present disclosure.

In other words, the structure of the display device according to embodiments of the present disclosure can refer to the figures of any one of the embodiments illustrated in FIG. 2, FIG. 3, FIG. 4, FIG. 5, FIG. 6 and FIG. 7, wherein the display panel 100 and the driving circuit 200 and the connection relationship of the two are illustrated in FIG. 2, FIG. 3, FIG. 4, FIG. 5, FIG. 6 and FIG. 7.

Based on the display device according to embodiments of the present disclosure, in another aspect of the present disclosure, a driving method of a display device according to embodiments of the present disclosure is provided, wherein the driving method of the display device is a method to dynamically adjust the cathode voltage of the display device of any one of the embodiments of the present disclosure.

Figure 10:
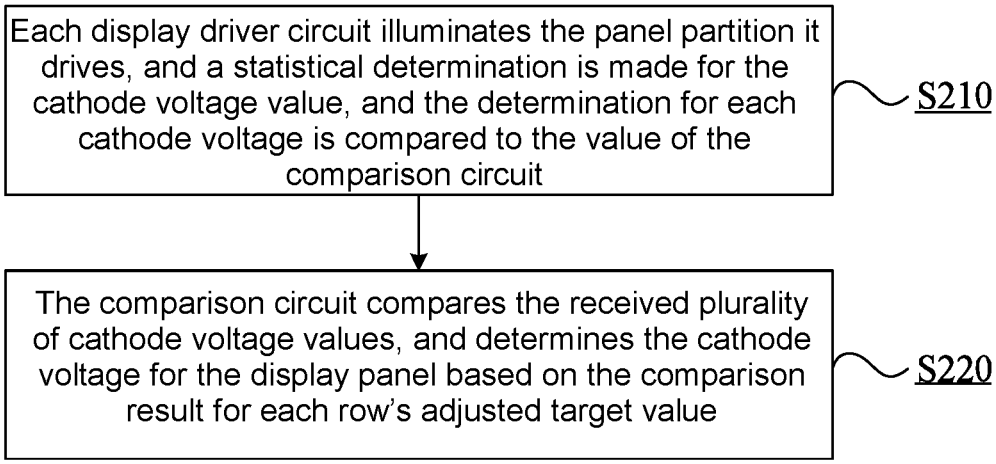
FIG. 10 illustrates an exemplary alternative a flow chart of a driving method of a display device according to some embodiments of the present disclosure.

FIG. 10 is a flow chart of a driving method of a display device according to embodiments of the present disclosure. As illustrated in FIG. 10, the driving method according to embodiments of the present disclosure can be executed by the display device.

As such, the display device can include: an OLED display panel with at least two panel partitions, a plurality of display driving circuits which can drive associated panel partitions in a one-to-one ratio, and a comparison circuit, wherein, the comparison circuit can respectively be connected to each display driving circuit.

In this embodiment, he driving method of the display device can include the following steps:

Step S210: utilizing each display driving circuit so as to collect brightness level statistics of the associated panel partition it drives, determine the cathode voltage value and transmit the cathode voltage value determined to the comparison circuit.

The driving method according to embodiments of the present disclosure is a method to dynamically adjust the cathode voltage of the OLED display panel of the display device according to any one of the embodiments of the present disclosure.

Based on the hardware characteristics of the display panel according to embodiments of the present disclosure, the light-emitting structure, i.e. OLED component, can include: cathodes, electron injection layer (EIL), electron transmission layer (ETL), light-emitting layer (EL), hole transmission layer (HTL), hole injection layer (HIL) and anodes.

As discussed herein the display device is an OLED display device, wherein each display driving circuit can communicate with a comparison circuit, after each display driving circuit collects brightness level statistics of the panel partition it drives and determines applicable cathode voltage value according to the statistics.

Each display driving circuit can then transmit the cathode voltage value determined to the comparison circuit, e.g., the comparison circuit can obtain the cathode voltage value applicable for each panel partition of the display panel.

It should be noted, the structure of the display device according to embodiments of the present disclosure can refer to the whole structure of the display panel and driving circuit of FIG. 2.

However, there are no limitations to the number of the panel partitions in the display panel and the number of the display driving circuits. In practical applications, the display panel can include three, four or more panel partitions, the number of display driving circuits can be the same as the number of panel partitions in the display panel, and they correspond to each other one-to-one, as long as it can be realized that a display driving circuit drives a panel partition.

As discussed in particular regard to illustrated step S20: the comparison circuit can compare the plurality of cathode voltage values and determine a target value that is utilized so as to adjust the cathode voltage value of the display panel according to the result of the comparison.

According to embodiments of the present disclosure, based on the hardware configuration in which a comparison circuit that can communicate with each display driving circuit is provided, the function of the display driving circuit in the display device can be provided which can be contain instructions to perform the following steps: utilize each display driving circuit can collect brightness level statistics of the panel partition it drives.

This step is different from what is in the existing technologies as shown in FIG. 1, which in contrast, in existing technologies, DDIC 1 that is connected to the Power IC through SWIRE collects brightness level statistics, because this DDIC1 can only collect brightness level statistics of division A, the ELVss value obtained can only be applicable for dynamically adjusting the cathode voltage of division A.

As such, if the whole display panel, including division A and division B, is adjusted with this ELVss value, the brightness level of division A and division B after the adjustment can be different. As a result, the display performance of the display device can be negatively influenced.

Compared with existing technologies, based on the capability of the comparison circuit to communicate with each display driving circuit according to embodiments of the present disclosure, each display driving circuit of the display device.

In this manner, the comparison circuit can respectively collect brightness level statistics of each associated panel partition it drives, and transmit the cathode voltage value obtained by each display driving circuit to the comparison circuit through the communication capability between the comparison circuit and each display driving circuit.

The comparison circuit can then be utilized to compare and analyze the plurality of cathode voltage values received to obtain a cathode voltage value that is applicable for all panel partition, e.g., the target value, the cathode voltage value of the whole display panel can then accordingly be adjusted according to the target value, such that the power consumption of the display device can be reduced.

The driving method of display device according to embodiments of the present disclosure can be adjusted based on the hardware configuration of the display device according to embodiments of the present disclosure.

In other words, when the comparison circuit is provided in the display device, which is respectively connected to the at least two display driving circuits, the driving method can then be utilized, wherein each display driving circuit can collect brightness level statistics of the panel partition it drives to obtain a cathode voltage value and transmit the cathode voltage value to the comparison circuit, the comparison circuit, after receiving the cathode voltage value (ELVss) obtained by each display driving circuit, can compare the plurality of cathode voltage values it receives and determine a target value which can be utilized to adjust the cathode voltage value of the whole display panel according to the result of the comparison.

As a result, the purpose of dynamic adjustment of the cathode voltage value of the whole display panel is realized. The driving method according to embodiments of the present disclosure can then realize the comparison of the cathode voltage value determined by each display driving circuit through the comparison circuit that can respectively communicate with each display driving circuit provided in the display device, as a result, the cathode voltage value of the whole display panel can be dynamically adjusted in accordance with a target value.

Figure 11:
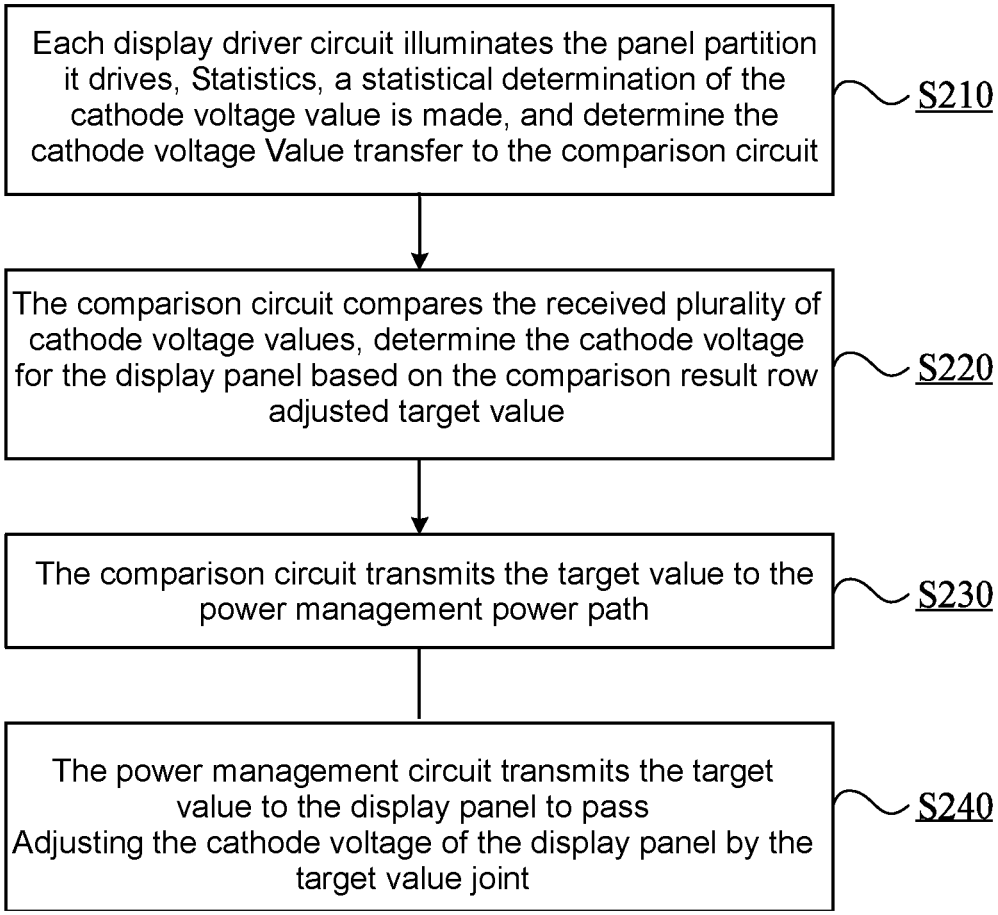
FIG. 11 illustrates an exemplary alternative a flow chart of another driving method of a display device according to some other embodiments of the present disclosure.

In some embodiments of the present disclosure, on the basis of the embodiment illustrated in FIG. 10, and as illustrated in FIG. 11, which is a flow chart of a driving method of another display device according to some embodiments of the present disclosure. In this embodiment the display device can further include: a power management circuit that can be respectively connected to the comparison circuit and the display panel, after step S220, the driving method according to embodiments of the present disclosure can further include the following steps:

S230: utilizing the comparison circuit so as to transmit the target value to the power management circuit; and S240: utilizing the power management circuit so as to transmit the target value to the display panel, wherein the cathode voltage of the display panel can be adjusted in accordance with the target value.

According to some embodiments of the present disclosure, the comparison circuit provided in the display device can determine a target value which can be utilized to adjust the cathode voltage of the whole display panel, including each panel partition in the display panel, according to cathode voltage value obtained from each display driving circuit.

In practical applications, the power management circuit, e.g. Power IC, can be utilized to conduct dynamic ELVss adjustment to the display panel. In this manner, the comparison circuit can transmit the target value to the power management circuit through SWIRE interface, and the power management circuit can transmit the target value to the whole display panel. Then passive cathode voltage adjustment of the display panel can be performed in accordance with the target value received.

As a result, dynamic adjustment of the cathode voltage can be realized.

It should be noted, the comparison circuit according to embodiments of the present disclosure can also be independently provided outside all display driving circuits or provided inside one of the display driving circuits.

The specific structures of the hardware configuration of the two types of display device, and the implementation method of dynamic adjustment of the cathode voltage of the display panel of these two types display devices have been described in detail in the embodiments illustrated in FIG. 4 and FIG. 7. In addition, the SPI communication mode and the feasibility of the communication between the comparison circuit and each display driving circuit based on SPI communication mode have been described in detail in the embodiments illustrated in FIG. 9 and Table 1, it will not be repeated herein.

In some embodiments of the present disclosure, each display frame of the display device can include a display period and an idle period, with reference to the sequence diagram of FIG. 8, according to embodiments of the present disclosure, the method of collecting brightness level statistics, determining the cathode voltage, determining the target value and dynamically adjusting the cathode voltage of the display panel in accordance with the target value can include:

During the idle period after the display period of the present display frame and before the display period of the next display frame, collecting the brightness level statistics of the next display frame, determining the cathode voltage, determining the target value and dynamically adjusting the cathode voltage of the display panel in accordance with the target value.

It can be seen from the sequence diagram of FIG. 8, data transmission can be executed during the display period of each display frame, the reference cathode voltage value (ELVss0) can be OV, the cathode voltage value (ELVss1) of the display frame before Blank 1, the cathode voltage value (ELVss2) of the display frame after Blank 1 and the cathode voltage value (ELVss3) of the display frame after Blank 2 are different, in other words, the cathode voltage of the display panel can be dynamically adjusted during display process.

Based on the factor of display time sequence of the display device, e.g., each display frame can include a display period and an idle period, the order of executing each operation of the display device according to embodiments of the present disclosure can be determined, there can be an idle period before and after the display period of each display frame, during the idle period after the completion of display of the present display frame and before the display period of the next display frame, the display device has obtained the display data information of the next display frame transmitted by AP, during this idle period, each operation according to embodiments of the present disclosure can be realized, for example, including: each DDIC can collect brightness level statistics of the data to be displayed of the next display frame of the panel partition it drives and determine the cathode voltage, each DDIC can send the data representing cathode voltage to the comparison circuit through SPI or I2C, a target value can be determined by the comparison circuit after it compares the plurality of cathode voltage values received; in other words, the ELVss value of the next display frame can be determined during the idle period before the arriving of the next display frame, and the ELVss value can be utilized to dynamically adjust the cathode voltage of the display panel.

In some embodiments of the present disclosure, the method of determining a target value by the comparison circuit can include a step of determining the minimum cathode value among the plurality of cathode voltage values received as the target value.

In some embodiments of the present disclosure, for an OLED display panel, during the display of the OLED component, DTFT is required to work at saturation region. In this case, the electric current of OLED component will not change as the voltage difference between the working voltage (ELVdd) and ELVss of the OLED component changes.

Then, the minimum voltage difference can have the best power-saving effect, display picture of different brightness level will influence the voltage difference, the lower the brightness level, the smaller the voltage difference required. As such, the minimum voltage difference needs to be determined so as to maintain quality of the display picture.

In addition, the voltage difference calculated according to ELVss determined by each display driving circuit is the minimum voltage difference that can satisfy the condition of normal display of the panel partition each display driving circuit drives.

In other words, after the ELVss of the whole display panel is adjusted, the voltage difference of each panel partition is not smaller than the abovementioned minimum voltage difference.

Therefore, each display driving circuit can collect brightness level statistics of the panel partition it drives, thus the minimum voltage difference is determined. In other words, after comparing the cathode voltage value determined by each display driving circuit, the minimum voltage value is determined as the target value that can be utilized to adjust the cathode voltage of the whole display panel.

The effect of reducing power consumption of the display device is optimized in this case.

In the driving method according to embodiments of the present disclosure, each DDIC, e.g. display driving circuit) can respectively collect brightness level statistics of the panel partition it drives and determine cathode voltage value, e.g. ELVss value, of the corresponding panel partition, and through the addition of communication function to each DDIC.

For example, utilizing the communication mode in which AP terminal can respectively communicate with each IC, or, utilizing the communication mode in which a certain DDIC can respectively communicate with other DDIC, the ELVss respectively determined by the plurality of DDIC can be compared, and the minimum ELVss value can be utilized as the target value to adjust the cathode voltage of the whole display panel.

Finally, the Power IC, e.g. power management circuit, can be controlled to output it to the display panel, the operation of dynamic adjustment of ELVss can thus be completed.

Figure 12:
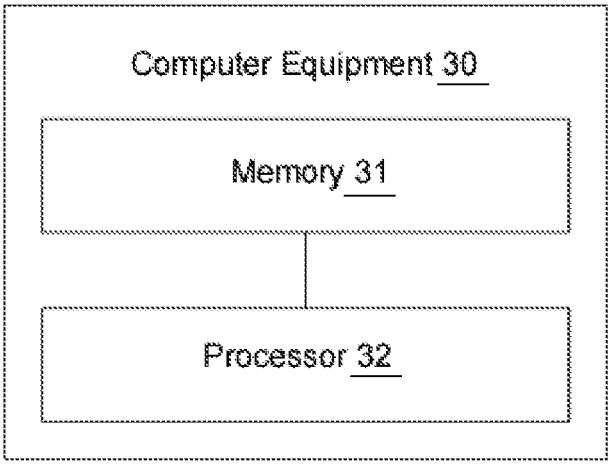
FIG. 12 illustrates an exemplary alternative a schematic structural view of a computing device according to some embodiments of the present disclosure.

In another aspect of the present disclosure, a computing device can be provided. FIG. 12 is a structural diagram of a computing device according to embodiments of the present disclosure. The computing device 30 according to embodiments of the present disclosure can include: a storage 31 and a processor 32.

Wherein, the storage 31 can be utilized to store executable commands.

The processor 32 can be utilized to execute the executable command stored in the storage 31 to realize the driving method of the display device according to embodiments of the present disclosure, the driving method is the method to dynamically adjust the cathode voltage of the display panel of the display device.

The implementation method of the computing device 30 according to embodiments of the present disclosure can be similar to the driving method of the display device according to embodiments of the present disclosure described above, it will not be repeated herein.

In another aspect of the present disclosure, a non-transitory computer-readable storage medium can be provided, the computer readable storage medium can store executable commands, wherein the executable commands can be executed by the processor. As such, the driving method according to embodiments of the present disclosure can be realized, wherein, the driving method is a method to dynamically adjust the cathode voltage of the display panel.

The implementation method of the computer readable storage medium is similar to the driving method of the display device according to embodiments of the present disclosure, it will not be repeated herein.

Various embodiments in this specification have been described in a progressive manner, where descriptions of some embodiments focus on the differences from other embodiments, and same or similar parts among the different embodiments are sometimes described together in only one embodiment.

It should also be noted that in the present disclosure, relational terms such as first and second, etc., are only used to distinguish one entity or operation from another entity or operation, and do not necessarily require or imply these entities having such an order or sequence. It does not necessarily require or imply that any such actual relationship or order exists between these entities or operations.

Moreover, the terms "include," "including," or any other variations thereof are intended to cover a non-exclusive inclusion such that a process, method, article, or apparatus that comprises a list of elements including not only those elements but also those that are not explicitly listed, or other elements that are inherent to such processes, methods, goods, or equipment.

In the case of no more limitation, the element defined by the sentence "includes a . . . " does not exclude the existence of another identical element in the process, the method, the commodity, or the device including the element.

The foregoing has provided a detailed description on a driving circuit, a display device, and driving method thereof according to some embodiments of the present disclosure. Specific examples are used herein to describe the principles and implementations of some embodiments. The description is only used to help understanding some of the possible methods and concepts. Meanwhile, those of ordinary skill in the art may change the specific implementation manners and the application scope according to the concepts of the present disclosure. The contents of this specification therefore should not be construed as limiting the disclosure.

In the foregoing method embodiments, for the sake of simplified descriptions, they are expressed as a series of action combinations. However, those of ordinary skill in the art will understand that the present disclosure is not limited by the described action sequence.

In the descriptions, with respect to circuit(s) unit(s), device(s), component(s), etc., in some occurrences singular forms are used, and in some other occurrences plural forms are used in the descriptions of various embodiments. It should be noted, however, the single or plural forms are not limiting but rather are for illustrative purposes. Unless it is expressly stated that a single unit, device, or component etc. is employed, or it is expressly stated that a plurality of units, devices or components, etc. are employed, the circuit(s), unit(s), device(s), component(s), etc. can be singular, or plural.

Based on various embodiments of the present disclosure, the disclosed apparatuses, devices, and methods may be implemented in other manners. For example, the abovementioned display substrates, display panels and display devices are only of illustrative purposes, and other types of display substrates, display panels and display devices can employ the methods disclosed herein.

Dividing the device into different "regions," "units," or "layers," etc. merely reflect various logical functions according to some embodiments, and actual implementations can have other divisions of "regions," "units," or "layers," etc. realizing similar functions as described above, or without divisions. For example, multiple regions, units, or layers, etc. may be combined or can be integrated into another system. In addition, some features can be omitted, and some steps in the methods can be skipped.

Those of ordinary skill in the art will appreciate that the units, regions, or layers, etc. in the devices provided by various embodiments described above can be configured in the one or more devices described above. They can also be located in one or multiple devices that is (are) different from the example embodiments described above or illustrated in the accompanying drawings. For example, the units, regions, or layers, etc. in various embodiments described above can be integrated into one module or divided into several submodules.

The order of the various embodiments described above are only for the purpose of illustration, and do not represent preference of embodiments.

Different programming techniques may be employed such as procedural or object-oriented. The routines may execute on a single processing device 6 or multiple processors. Although the steps, operations, or computations may be presented in a specific order, the order may be changed in different particular embodiments. In some particular embodiments, multiple steps shown as sequential in this specification may be performed at the same time.

A "processor" or "processing circuit" can be employed to realize some of the functions, devices, circuits, or methods described above, and can include any suitable hardware and/or software system, mechanism or component that processes data, signals or other information. A processor or processing circuit may include a system with a general-purpose central processing circuit, multiple processing circuits, dedicated circuitry for achieving functionality, or other systems.

Processing need not be limited to a geographic location, or have temporal limitations. For example, a processor may perform its functions in "real-time," "offline," in a "batch mode," etc. Portions of processing may be performed at different times and at different locations, by different (or the same) processing systems. Various embodiments disclosed herein can be realized via hardware and/or software, such as a computer program stored on a memory.

The functions as described above according to various embodiments of the present disclosure, if implemented in the form of software functional blocks and sold or used as a stand-alone product, may be stored in a computer-readable storage medium. Based on such understanding, some of the technical solutions of the present disclosure can be embodied in the form of a software product stored in a storage medium, including a plurality of instructions that are used to cause a computer device (which may be a personal computer, a mobile terminal, a server, or a network device, etc.) to perform all or part of the steps of the methods described in the various embodiments of the present disclosure.

Although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the exemplary embodiments, in addition to those described above, can be made by a person of ordinary skill in the art, having the benefit of the present disclosure, without departing from the spirit and scope of the disclosure defined in the following claims, the scope of which is to be accorded the broadest interpretation to encompass such modifications and equivalent structures.

The invention claimed is:

1. A display panel driving system comprising:

a display panel having a first panel partition and a second panel partition;

a first display driving circuit operatively connected to the first panel partition, the first display driving circuit being utilized for driving the first panel partition;

a second display driving circuit operatively connected to the second panel partition, the second display driving circuit being utilized for driving the second panel partition; and a comparison circuit, wherein:

the comparison circuit is respectively connected to each of the first display driving circuit and the second display driving circuit;

each display driving circuit is utilized to collect brightness level statistics associated with the display panel partitions it drives;

each display driving circuit is configured to determine a cathode voltage value associated with the display panel partition it drives and transmit the cathode voltage value to the comparison circuit;

the comparison circuit is utilized to compare each cathode voltage value for each of the panel partitions received and determine a target value which is then utilized to adjust the cathode voltage of the whole display panel;

the cathode voltage of the whole display panel is a dynamic cathode voltage (ELVss);

the first display driving circuit comprises a first display driver integrated circuit (DDIC1);

the second display driving circuit comprises a second display driver integrated circuit (DDIC2);

the target value is a minimum cathode voltage based on the comparison circuit's comparing each cathode voltage value; and after the dynamic cathode voltage (ELVss) of the whole display panel is adjusted based on the target value, a voltage difference of each panel partition is not smaller than a minimum voltage difference between a working voltage (ELVdd) and the dynamic cathode voltage (ELVss).

2. The display panel driving system of claim 1, wherein the comparison circuit is utilized to determine a target value according to the minimum cathode voltage value among a plurality of cathode voltage values received.

3. The display panel driving system of claim 1, further comprising a power management circuit being connected to the comparison circuit and the display panel, wherein the comparison circuit is further utilized to transmit the target value to the power management circuit; and wherein the power management circuit is utilized to transmit the target value received to the display panel, such that the cathode voltage value of the display panel can be adjusted according to the target value.

4. The display panel driving system of claim 1, wherein the comparison circuit is provided externally to each display driving circuit, and wherein each display driving circuit is connected to the comparison circuit through a serial peripheral interface or a two-wire interface serial bus.

5. The display panel driving system of claim 1, wherein the comparison circuit is provided inside the first display driving circuit, and the first display driving circuit is respectively connected to each second display driving circuit through a serial peripheral interface or a two-wire interface serial bus.

6. The display panel driving system of claim 3, wherein the power management circuit is connected to the display panel through a signal line interface.

7. The display panel driving system of claim 3, wherein each display panel operates in a plurality of display frames, wherein each display frame comprises a display period and an idle period; wherein the driving circuit is utilized to collect brightness level statistics of a subsequent display frame, determine an associated cathode voltage, determine an associated target value and adjust the cathode voltage of the display panel in accordance with the associated target value during the idle period that is after the display period of a present display frame and before the display period of the subsequent display frame.

8. The display panel driving system of claim 1, wherein the display panel is an organic light-emitting diode display panel.

9. A driving method of a display device, the method comprising:

providing an organic electroluminescent display panel having a plurality of panel partitions;

providing a plurality of display driving circuits that respectively drive each of the plurality of panel partitions in a one-to-one ration;

providing a comparison circuit, wherein the comparison circuit is respectively connected to each display driving circuit;

utilizing each display driving circuit so as to collect associated brightness level statistics of each panel partition;

utilizing each display driving circuit so as to determine a cathode voltage value for each panel partition, and transmit the cathode voltage value to the comparison circuit;

utilizing the comparison circuit so as to compare each of the cathode voltage values associated with each panel partition; and determining a target value for each panel partition which is then utilized to adjust a cathode voltage provided to the organic electroluminescent display panel;

wherein:

the cathode voltage provided to the organic electroluminescent display panel is a dynamic cathode voltage (ELVss);

the plurality of display driving circuits include a first display driving circuit comprising a first display driver integrated circuit (DDIC1);

the plurality of display driving circuits include a second display driving circuit comprising a second display driver integrated circuit (DDIC2);

the target value is a minimum cathode voltage based on the comparison circuit's comparing each of the cathode voltage values associated with each panel partition; and after the dynamic cathode voltage (ELVss) of the whole display panel is adjusted based on the target value, a voltage difference of each panel partition is not smaller than a minimum voltage difference between a working voltage (ELVdd) and the dynamic cathode voltage (ELVss).

10. The driving method of a display device of claim 9, wherein step of determining the target value is performed by the comparison circuit, and wherein this step further comprises:

determining a minimum cathode voltage value among each of the cathode voltage values received as the target value.

11. The driving method driving method of a display device of claim 9, wherein the display device further comprises a power management circuit that is respectively connected to the comparison circuit and the display panel, and wherein the method further comprises steps of:

utilizing the comparison circuit to transmit the target value to the power management circuit;

utilizing the power management circuit to transmit the target value to the display panel in order to adjust the cathode voltage of the display panel in accordance with each target value.

12. The driving method of the display device of claim 11, wherein:

each display frame of the display device operates having a display period and an idle period; and the method further comprises:

obtaining the brightness level statistics, determining the cathode voltage, determining the target value and adjusting the cathode voltage of the display panel in accordance the target value comprises:

collecting brightness level statistics of a subsequent display frame during the idle period after the display period of the present display frame and before the display period of the next display frame;

determining the cathode voltage;

determining the target value; and adjusting the cathode voltage of the display panel in accordance with the target value.

13. A computing device operatively connected to a display panel, wherein the computing device comprises:

a storage device; and a processor operatively connected to the storage device and to the display panel;

wherein the storage device is utilized to store executable commands, and wherein the processor is utilized to execute the executable commands configured to instruct the processor to perform the steps of the driving method of the display device according to claim 9.

14. A non-transitory computer-readable storage medium, wherein, the computer readable medium is utilized to store executable commands, when the executable commands are executed so as to perform the driving method according to claim 9.

15. A display panel driving system, the system comprising:

a display panel having a plurality of panel partitions, wherein the display panel is an organic light-emitting diode display panel;

a plurality of display driving circuits operatively connected to each of the plurality of panel partitions;

a driving circuit, the driving circuit further comprising:

a plurality of display driving circuits each of the panel partitions having an associated display driving circuit in a one-to-one ratio;

a comparison circuit;

a power management circuit being connected to the comparison circuit and the display panel; wherein the comparison circuit is respectively connected to each of the display driving circuits;

each display driving circuit is utilized to collect brightness level statistics associated with each associated display panel partitions driven thereby;

each display driving circuit is configured to determine an associated cathode voltage value associated with its particular display panel partition driven thereby and transmit the associated cathode voltage value to the comparison circuit;

the comparison circuit is utilized to compare each associated cathode voltage value for each of the panel partitions and determine a target value which is then utilized to adjust the cathode voltage of the whole display panel; and the comparison circuit is utilized to transmit the target value to the power management circuit;

the cathode voltage of the whole display panel is a dynamic cathode voltage (ELVss);

the plurality of display driving circuits include a first display driving circuit comprising a first display driver integrated circuit (DDIC1);

the plurality of display driving circuits include a second display driving circuit comprising a second display driver integrated circuit (DDIC2);

the target value is a minimum cathode voltage based on the comparison circuit's comparing each of the cathode voltage values associated with each panel partition; and after the dynamic cathode voltage (ELVss) of the whole display panel is adjusted based on the target value, a voltage difference of each panel partition is not smaller than a minimum voltage difference between a working voltage (ELVdd) and the dynamic cathode voltage (ELVss).

16. The display panel driving system of claim 15, wherein the comparison circuit is utilized to determine a target value according to the minimum cathode voltage value among a plurality of cathode voltage values received.

17. The display panel driving system of claim 15, wherein the power management circuit is utilized to transmit the target value received to the display panel, such that the cathode voltage value of the display panel can be adjusted according to the target value.

18. The display driving system of claim 17, wherein the brightness level statistics is obtained by:

in accordance with the pixel grayscale values, statistically calculating minimum voltage differences required for each gray level.

19. The display driving system of claim 18, wherein the brightness level statistics is further obtained by:

transmitting a black picture to the display panel;

measuring display brightness of the black picture;

adjusting the cathode voltage values of the display incrementally; and determining the minimum voltage differences that would not affect the display brightness.

20. The display driving system of claim 19, wherein the brightness level statistics is further obtained by learning a correspondence between brightness and voltage difference.

* * * * *